US011090956B2

(12) United States Patent
Akahane

(10) Patent No.: US 11,090,956 B2
(45) Date of Patent: Aug. 17, 2021

(54) PRINTING APPARATUS

(71) Applicant: SEIKO EPSON CORPORATION, Tokyo (JP)

(72) Inventor: Takashi Akahane, Miyada (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 16/211,024

(22) Filed: Dec. 5, 2018

(65) Prior Publication Data

US 2019/0168522 A1 Jun. 6, 2019

(30) Foreign Application Priority Data

Dec. 6, 2017 (JP) ..... JP2017-234015

(51) Int. Cl.

| | |
|---|---|
| ***B41J 15/16*** | (2006.01) |
| ***B65H 23/16*** | (2006.01) |
| ***B65H 5/06*** | (2006.01) |
| ***B65H 23/195*** | (2006.01) |
| ***B41J 15/04*** | (2006.01) |
| ***B65H 23/192*** | (2006.01) |
| ***B65H 23/18*** | (2006.01) |

(52) U.S. Cl.

CPC ..... *B41J 15/16* (2013.01); *B41J 15/046* (2013.01); *B41J 15/165* (2013.01); *B65H 5/064* (2013.01); *B65H 23/16* (2013.01); *B65H 23/1806* (2013.01); *B65H 23/192* (2013.01); *B65H 23/1955* (2013.01); *B65H 2404/62* (2013.01); *B65H 2801/36* (2013.01)

(58) Field of Classification Search

CPC ..... B41J 15/16; B41J 15/046; B41J 15/165; B41J 23/16; B41J 23/1806; B41J 23/192; B41J 23/1955; B41J 2404/62; B41J 2801/36; B65H 23/16; B65H 23/1806; B65H 23/192; B65H 23/1955; B65H 2404/62; B65H 2801/36

See application file for complete search history.

(56) References Cited

U.S. PATENT DOCUMENTS 3,679,149 A * 7/1972 Ottavan ..... B65H 23/1955 242/413.7
5,119,982 A * 6/1992 Hutzenlaub ..... B65H 23/16 226/44

(Continued)

FOREIGN PATENT DOCUMENTS

| | | |
|---|---|---|
| JP | 2009-062150 | 3/2009 |
| JP | 2013-022744 | 2/2013 |

*Primary Examiner* — David H Banh
(74) *Attorney, Agent, or Firm* — Workman Nydegger

(57) ABSTRACT

A printing apparatus includes a transport unit configured to transport a medium, a winding unit disposed downstream, in a transport direction, of the transport unit, the winding unit being configured to wind the medium, and a tension applying unit including a rod member biased toward the medium between the transport unit and the winding unit, the rod member being for applying a tension to the medium. The tension applying unit is configured so that the rod member moves along a predetermined direction as at least one of the transport unit and the winding unit is driven to transport the medium. An upper limit position of a movement of the tension bar along the predetermined axis is changed according to a winding mode of the winding unit.

11 Claims, 7 Drawing Sheets

(56) References Cited

U.S. PATENT DOCUMENTS

| | | | | |
|---|---|---|---|---|
| 5,660,351 | A * | 8/1997 | Osanai | B65H 18/26<br>242/533.4 |
| 5,825,374 | A * | 10/1998 | Albertalli | B41J 11/0085<br>346/136 |
| 2017/0087903 | A1* | 3/2017 | Yamabe | B41J 15/16 |
| 2017/0113474 | A1* | 4/2017 | Lane | B41J 15/16 |

* cited by examiner

PRINTING APPARATUS

BACKGROUND

1. Technical Field

The present invention relates to a printing apparatus.

2. Related Art

A large-scale printing apparatus is configured by a so-called roll-to-roll scheme in which a long medium is supplied in a roll medium (not printed medium) format and then transported by a transport unit and a printed medium printed by a printing unit is wound by a winding unit for collection. In such a printing apparatus, a tension applying unit is often provided which applies a tension to the medium between the transport unit and the winding unit to stably wind the medium around the winding unit. For example, JP-A-2013-022744 discloses a recording device (printing apparatus) includes a tension applying mechanism configured to apply a tension to a band-shaped medium, the tension applying mechanism including a tension applying member and a pair of arm members configured to support the tension applying member. The tension applying mechanism is provided with an upper limit sensor configured to obtain an upper limit position of an inclined angle of the arm member and a lower limit sensor configured to obtain a lower limit position thereof. With these sensors, winding of the medium of the winding unit is controlled and the tension applying member is swung within a fixed angle range to exert a tension within a predetermined range onto the medium.

Types of a roll medium used for a printing apparatus include a roll body wound so that a printed surface is directed outwardly (hereinafter, "outward winding") and a roll body wound so that a printed surface is directed inwardly (hereinafter, "inward winding"). To correspond to these roll media types, it is necessary to wind the printed medium outwardly or inwardly in the winding unit of the printing apparatus. However, in the printing apparatus described in JP-A-2013-022744, the upper limit position and the lower limit position are fixed, and thus, there is a difference in angle of the medium moving from a rod member (tension applying member) to the winding unit depending on the outward winding or the inward winding, and the size of a roll diameter, resulting in a problem that the tension exerted on the medium is changed.

SUMMARY

Some aspects of the invention address at least some of the above-described issues, and can be realized as the following modes or application examples.

Application Example 1

A printing apparatus according to the present application example includes a transport unit configured to transport a medium, a winding unit disposed downstream, in a transport direction, of the transport unit, the winding unit being configured to wind the medium, and a tension applying unit including a rod member biased toward the medium between the transport unit and the winding unit, the rod member being for applying a tension to the medium. The tension applying unit is configured so that the rod member moves along a predetermined axis as at least one of the transport unit and the winding unit is driven to transport the medium, and an upper limit position of a movement of the rod member along the predetermined axis is changed according to a winding mode of the winding unit.

According to the present application example, the printing apparatus includes the winding unit configured to wind the medium and the tension applying unit including a rod member for applying a tension to the medium. The upper limit position of the movement of the rod member along the predetermined axis is changed according to a winding mode of the winding unit, that is, whether the medium is wound inwardly or wound outwardly. As a result, at the upper limit position, an angle difference of the medium moving from the rod member to the winding unit generated depending on the winding mode is reduced, and thus, it is possible to suppress a change in tension exerted on the medium.

Application Example 2

In the printing apparatus described in the above-described application example, the upper limit position is preferably changed according to a diameter of the medium wound around the winding unit.

According to the present application example, when the medium is wound around the winding unit, the diameter of the roll body is small at the start of the winding, and the diameter gradually increases in size, therefore, the upper limit position of a movement of the rod member of the present application example along the predetermined axis is changed according to the diameter of the medium wound around the winding unit. As a result, at the upper limit position, an angle difference of the medium moving from the rod member to the winding unit generated depending on the size of the diameter of the medium wound around the winding unit is reduced, and thus, it is possible to suppress a change in tension exerted on the medium.

Application Example 3

In the printing apparatus described in the above-described application example, the rod member is preferably configured to pivot along a circumference, and the tension applying unit preferably includes a pivot shaft around which the rod member pivots and a detection unit configured to detect a displacement of a pivot of the pivot shaft.

According to the present application example, the tension applying unit includes the detection unit configured to detect the displacement of the pivot of the pivot shaft of the rod member, and thus, the upper limit position of the rod member can be changed, based on an output signal of the detection unit.

Application Example 4

In the printing apparatus described in the above-described application example, the lower limit position of a movement of the rod member along the predetermined axis is preferably changed according to a winding mode of the winding unit.

According to the present application example, the lower limit position of the movement of the rod member along the predetermined axis is changed according to a winding mode of the winding unit, that is, whether the medium is wound inwardly or wound outwardly. As a result, at the lower limit position, an angle difference of the medium moving from the rod member to the winding unit generated depending on the winding mode is reduced, and thus, it is possible to suppress a change in tension exerted on the medium.

Application Example 5

In the printing apparatus described in the above-described application example, the lower limit position of a movement of the rod member along the predetermined axis is preferably changed according to a diameter of the medium wound around the winding unit.

According to the present application example, when the medium is wound around the winding unit, the diameter of the roll body is small at the start of the winding, and the diameter gradually increases in size, therefore, the lower limit position of a movement of the rod member of the present application example along the predetermined axis is changed according to the diameter of the medium wound around the winding unit. As a result, at the lower limit position, an angle difference of the medium moving from the rod member to the winding unit generated depending on the size of the diameter of the medium wound around the winding unit is reduced, and thus, it is possible to suppress a change in tension exerted on the medium.

Application Example 6

A printing apparatus according to the present application example includes a transport unit configured to transport a medium, a winding unit disposed downstream, in a transport direction, of the transport unit, the winding unit being configured to wind the medium, and a tension applying unit including a rod member biased toward the medium between the transport unit and the winding unit, the rod member being for applying a tension to the medium. The tension applying unit is configured so that the rod member moves along a predetermined axis as at least one of the transport unit and the winding unit is driven to transport the medium, and an upper limit position of a movement of the rod member along the predetermined axis is changed according to a diameter of the medium wound around the winding unit.

According to the present application example, the printing apparatus includes the winding unit configured to wind the medium and the tension applying unit including a rod member for applying a tension to the medium. When the medium is wound around the winding unit, the diameter of the roll body is small at the start of the winding, and the diameter gradually increases in size, therefore, the upper limit position of a movement of the rod member of the present application example along the predetermined axis is changed according to the diameter of the medium wound around the winding unit. As a result, at the upper limit position, an angle difference of the medium moving from the rod member to the winding unit generated depending on the size of the diameter of the medium wound around the winding unit is reduced, and thus, it is possible to suppress a change in tension exerted on the medium.

Application Example 7

In the printing apparatus described in the above-described application example, the upper limit position is preferably changed according to a winding mode of the medium wound around the winding unit.

According to the present application example, the upper limit position of the movement of the rod member along the predetermined axis is changed according to a winding mode of the winding unit, that is, whether the medium is wound inwardly or wound outwardly. As a result, at the upper limit position, an angle difference of the medium moving from the rod member to the winding unit generated depending on the winding mode is reduced, and thus, it is possible to suppress a change in tension exerted on the medium.

Application Example 8

In the printing apparatus described in the above-described application example, the rod member is preferably configured to pivot along a circumference, and the tension applying unit preferably includes a pivot shaft around which the rod member pivots and a detection unit configured to detect a displacement of a pivot of the pivot shaft.

According to the present application example, the tension applying unit includes the detection unit configured to detect the displacement of the pivot of the pivot shaft of the rod member, and thus, the upper limit position of the rod member can be changed, based on an output signal of the detection unit.

Application Example 9

In the printing apparatus described in the above-described application example, the lower limit position of a movement of the rod member along the predetermined axis is preferably changed according to a winding mode of the winding unit.

According to the present application example, the lower limit position of the movement of the rod member along the predetermined axis is changed according to a winding mode of the winding unit, that is, whether the medium is wound inwardly or wound outwardly. As a result, at the lower limit position, an angle difference of the medium moving from the rod member to the winding unit generated depending on the winding mode is reduced, and thus, it is possible to suppress a change in tension exerted on the medium.

Application Example 10

In the printing apparatus described in the above-described application example, the lower limit position of a movement of the rod member along the predetermined axis is preferably changed according to a diameter of the medium wound around the winding unit.

According to the present application example, when the medium is wound around the winding unit, the diameter of the roll body is small at the start of the winding, and the diameter gradually increases in size, therefore, the lower limit position of a movement of the rod member of the present application example along the predetermined axis is changed according to the diameter of the medium wound around the winding unit. As a result, at the lower limit position, an angle difference of the medium moving from the rod member to the winding unit generated depending on the size of the diameter of the medium wound around the winding unit is reduced, and thus, it is possible to suppress a change in tension exerted on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of the invention will be described below with reference to the drawings. Note that, in each of the figures below, to illustrate each of members and the like in a recognizable size, each of the members and the like is illustrated to a scale different from an actual scale.

Figure 1:
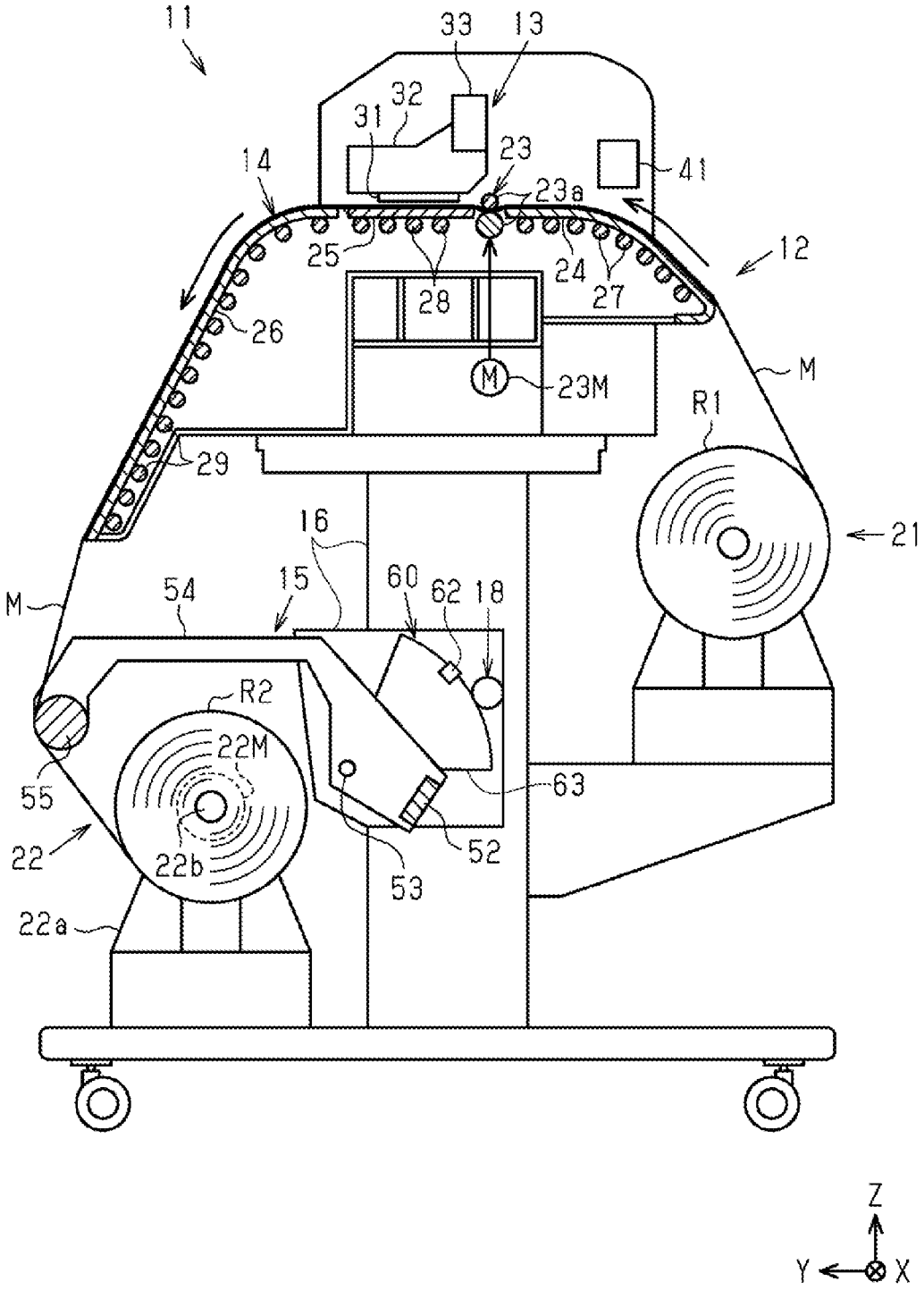
FIG. 1 is a cross-sectional view schematically illustrating a configuration of a printing apparatus according to an exemplary embodiment.
Figure 2:
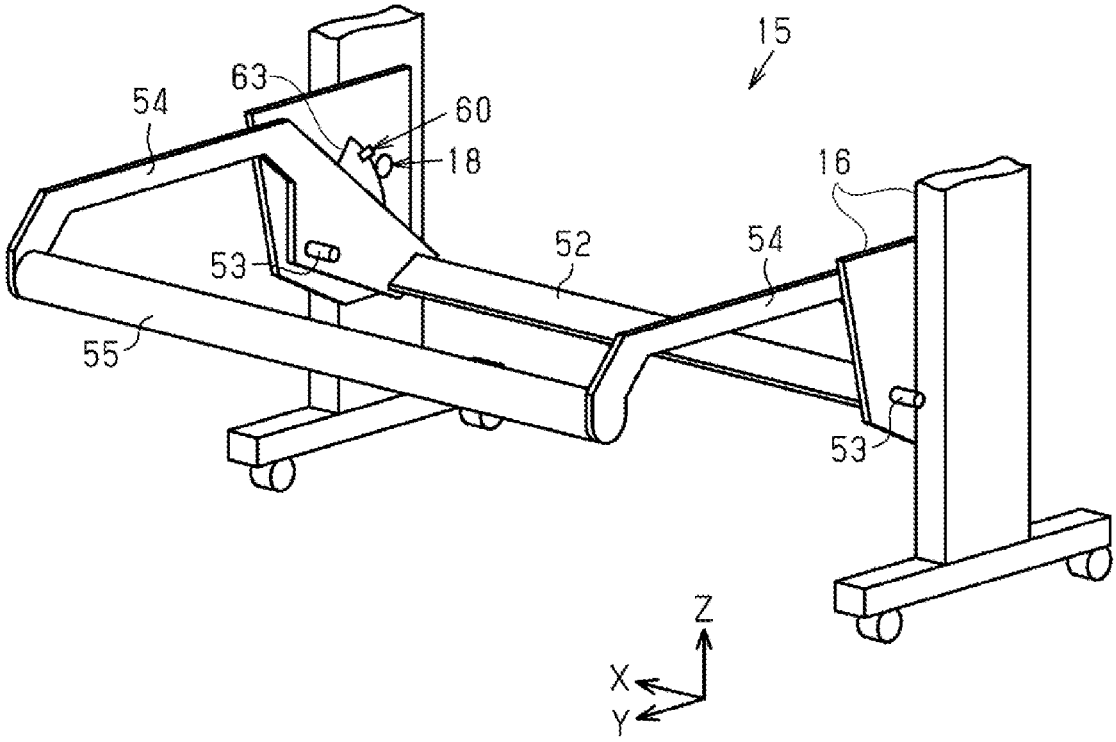
FIG. 2 is a perspective view illustrating a configuration of a tension applying unit.

Furthermore, in FIG. 1 and FIG. 2, for simplicity, an X-axis, a Y-axis, and a Z-axis are illustrated as three axes perpendicular to one another, and a leading end side of an arrow is referred to as a "+ side", and a trailing end side of the arrow is referred to as a "− side".

Exemplary Embodiments

Firstly, a configuration of a printing apparatus will be described. The printing apparatus is an ink jet-type printer, for example. In the description of the exemplary embodiment, a large format printer (LFP) configured to handle a relatively large medium will be used as an example of the configuration of the printing apparatus.

FIG. 1 is a cross-sectional view schematically illustrating a configuration of the printing apparatus. As illustrated in FIG. 1, a printing apparatus 11 includes a transport mechanism 12 configured to transport a medium M in a roll-to-roll scheme, a printing unit 13 configured to discharge an ink to a predetermined region of the medium M to print an image, a text and the like, a medium support unit 14 configured to support the medium M, a tension applying unit 15, and a control unit 41 configured to control these constitutional components. The constitutional components are supported by a main body frame 16 having a carriage. Note that the medium M is made of a vinyl chloride film and the like having a width of about 64 inches. In the exemplary embodiment, a vertical axis along the gravity axis is referred to as "Z-axis", an axis in which the medium M is transported in the printing unit 13 is referred to as "Y-axis", and a width axis of the medium M is referred to as "X-axis".

The transport mechanism 12 includes a feed unit 21 configured to feed out the medium M in a roll shape to the printing unit 13, and a winding unit 22 configured to wind the fed medium M printed in the printing unit 13. The transport mechanism 12 includes a transport unit 23 in the middle of a transport path between the feed unit 21 and the winding unit 22 configured to transport the medium M in a transport direction (arrow direction in the figure). The transport unit 23 includes a pair of transporting rollers 23*a* and a transport motor 23M configured to output a rotation drive to the pair of transporting rollers 23*a*. The transport unit 23 illustrated in FIG. 1 includes one pair of transporting rollers 23*a*, but may include a plurality of pairs of transporting rollers 23*a*. Further, the transport unit 23 is not limited to a roller-type transport, and may at least partially include a belt-type transport having a transport belt on which the medium M is carried for transportation.

The feed unit 21 is disposed upstream, in the transport direction, of the transport unit 23. In the feed unit 21, a roll body R1 with an unused medium M winding and overlapping in a cylindrical manner is held. The feed unit 21 is loaded with the roll bodies R1 having plurality of sizes different in width of the medium M (length in the X-axis) and the number of windings exchangeably. When the feed unit 21 rotates counterclockwise the roll body R1 in FIG. 1 by a power of a feed motor (not illustrated), the medium M is released from the roll body R1 and fed to the printing unit 13.

The winding unit 22 is disposed downstream, in the transport direction, of the transport unit 23. The winding unit 22 forms a roll body R2 obtained as a result of the medium M printed in the printing unit 13 being wound in a cylindrical manner. The winding unit 22 includes a pair of holders 22*a* configured to grasp a pair of winding shafts 22*b* configured to support a cylinder-like core material for forming the roll body R2 by winding the medium M, and a winding motor 22M configured to output a power for rotating the pair of winding shafts 22*b*. When the winding motor 22M is driven so that the winding shaft 22*b* is rotated counterclockwise in FIG. 1, the medium M is wound around the core material supported by the winding shaft 22*b* so that the roll body R2 is formed.

The printing unit 13 includes a recording head 31 capable of discharging the ink toward the medium M, and a carriage moving unit 33 configured to reciprocate the carriage 32 on which the recording head 31 is mounted in an axis (X-axis) intersecting with the transport direction. The recording head 31 includes a plurality of nozzles, and is configured to be capable of discharging the ink from each of the plurality of nozzle. When a main scanning where the ink is discharged from the recording head 31 while reciprocating, by the carriage moving unit 33, the carriage 32 in the X-axis and a sub scanning where the transport mechanism 12 transports the medium M into the transport direction are repeated, an image, a text and the like are printed on the medium M.

The medium support unit 14 is configured to be capable of supporting the medium M in the transport path of the medium M, and includes a first support unit 24 disposed between the feed unit 21 and the pair of transporting rollers 23*a*, a second support unit 25 facing the printing unit 13, and a third support unit 26 disposed between a downstream side end of the second support unit 25 and the winding unit 22.

The printing apparatus 11 includes a first heater (pre-heater) 27 configured to heat the medium M, a second heater 28, and a third heater (after-heater) 29. When control unit 41 drives the first, second, and third heaters 27, 28, 29, a surface supporting the medium M in the medium support unit 14 is heated by heat conduction, and the medium M is heated from a side of the medium M which is different from a side of the medium on which the medium is printed. The first heater 27 heats the first support unit 24 to preheat the medium M at an upstream side in the transport direction (−Y-axis side) relative to the printing unit 13. The second heater 28 heats the second support unit 25, and heats the medium M in a discharge region of the printing unit 13. The third heater 29 heats the third support unit 26 and heats the medium M on the third support unit 26 so that an undried ink, out of the ink landed on the medium M is completely dried and fixed at least before the medium M is wound by the winding unit 22.

The tension applying unit 15 includes a tension bar 55, as a rod member configured to apply a tension to the medium M, where the tension bar 55 is biased toward the medium M between the transport unit 23 and the winding unit 22. The tension applying unit 15 of the present exemplary embodiment applies the tension to a portion of the medium M extending in the air between the winding unit 22 and a downstream end (that is, a lower end of the third support unit 26) in the transport direction of the medium support unit 14. The tension applying unit 15 includes a pivot shaft 53 for a pivot of the tension bar 55 and the tension bar 55 pivots around the pivot shaft 53. The tension bar 55 applies the tension to the medium M by contacting a surface of the medium M which is different from the surface of the medium on which an image and the like is printed by the printing unit 13.

FIG. 2 is a perspective view illustrating a configuration of the tension applying unit. Next, the configuration of the tension applying unit 15 will be described with reference to FIG. 1 and FIG. 2. The tension applying unit 15 is configured so that the tension bar 55 moves along a predetermined axis as at least one of the transport unit 23 and the winding unit 22 is driven to transport the medium. In particular, as illustrated in FIG. 1 and FIG. 2, the tension applying unit 15 includes a pair of arms 54 capable of rotationally moving around the pivot shaft 53, the tension bar 55 supported at one end of the pair of arms 54 and capable of contacting the medium M, and a counterweight 52 supported at another end of the pair of arms 54. The tension bar 55 connects the distal ends of the pair of arms 54, and the counterweight 52 includes a long member connecting the proximal ends of the pair of arms 54.

The tension bar 55 is of columnar shape and is formed to be longer in a width axis than a width of the medium M. The counterweight 52 is of cuboid shape, and formed to have substantially the same length as the tension bar 55. The tension bar 55 and the counterweight 52 configure a weight of the tension applying unit 15. When the pair of arms 54 are supported by the pivot shaft 53 disposed in the main body frame 16 between the tension bar 55 and the counterweight 52 disposed at the both ends in a longitudinal axis of each of the pair of arms 54, the tension applying unit 15 can pivot around the pivot shaft 53. When the medium M between a lower end of the third support unit 26 and the winding unit 22 is transported, the tension bar 55 pivots along a circumference around the pivot shaft 53, being a predetermined axis.

The pair of arms 54 have shapes curved convexly upward in the vertical axis (Z-axis). With this shape, the tension bar 55 can contact the medium M with avoiding the holders 22*a* and the like disposed at the both ends in the width axis (X-axis) of the medium M of the winding unit 22 and configured to support a shaft for winding the medium M, and thus, it is possible to decrease a dimension in the width axis of the tension applying unit 15. As a result, it is possible to reduce an occasion where the tension applying unit 15 contacts another object such as an operator. Further, the tension bar 55 and the counterweight 52 are configured of a long member connecting the pair of arms 54, and thus, a torsional rigidity of the tension applying unit 15 is improved, as a result of which it is possible to prevent a deformation of the tension applying unit 15 even if the tension applying unit 15 contacts the other object.

Figure 3:
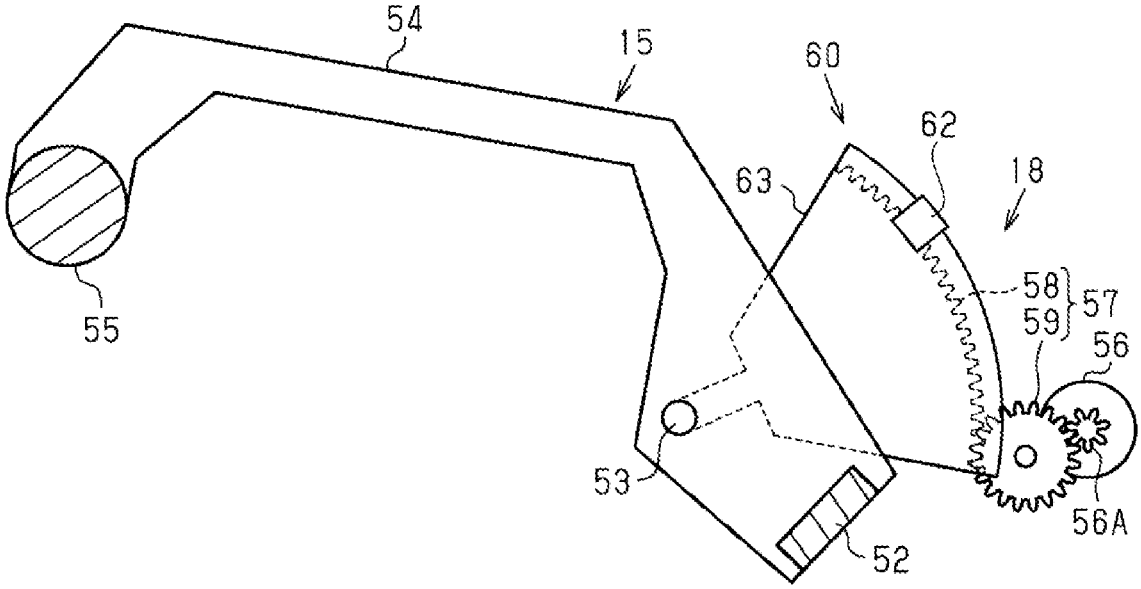
FIG. 3 is a lateral side view illustrating a main part of the tension applying unit.

FIG. 3 is a lateral side view illustrating a main part of the tension applying unit 15. As illustrated in FIG. 3, the tension applying unit 15 includes a tension bar drive unit 18 configured to pivot (drive) the tension bar 55. The tension bar drive unit 18 includes an electric motor 56, and a transmission gear mechanism 57 meshing with a drive gear 56A capable of rotating together with the output shaft of the electric motor 56 and configured to transmit the power of the pivot to the pivot shaft 53. The transmission gear mechanism 57 includes a fan-shaped gear 58 (sector gear) disposed in one of the arms 54 to be capable of rotationally moving around the pivot shaft 53, and a gear mechanism 59 interposed between the drive gear 56A and the fan-shaped gear 58. Note that in the present exemplary embodiment, an example is illustrated where the gear mechanism 59 is configured of one gear, but a configuration where a plurality of gears are provided may also be possible.

A rotation force output from the electric motor 56 is transmitted, via the drive gear 56A and the gear mechanism 59, to the fan-shaped gear 58, and when the pivot shaft 53, together with the fan-shaped gear 58, is pivoted, the pair of arms 54 are pivoted. As a result, the rotation force (biasing force) in the pivot axis is applied to the tension bar 55 supported by the pair of arms 54. When the electric motor 56 is controlled to be driven by the control unit 41, the tension bar drive unit 18 can adjust the biasing force applied by the tension bar 55 to the medium M.

Further, the tension applying unit 15 includes a detection unit 60 configured to detect a displacement of the pivot of the pivot shaft 53. The detection unit 60 includes a scale unit 63 and a detector 62. The scale unit 63 forms a fan-like shape around the pivot shaft 53, and is disposed at one of the arms 54. A surface of a peripheral edge (arc portion) of the scale unit 63 is provided with a magnetic scale in which magnets different in polarity are alternatively disposed. The detector 62 is fixed at a position facing the magnetic scale of the scale unit 63. The detector 62 includes an element (such as a hall element and an MR element) configured to convert a change in magnetic field into an electric signal, and detects a relative movement amount (pivot amount) relative to the scale unit 63. This enables obtaining the position of the tension bar 55 rotationally moving around the pivot shaft 53.

Note that in the present exemplary embodiment, a configuration is illustrated where the scale unit 63 moves along with the pivot of the pivot shaft 53 relative to the fixed detector 62, but a configuration where the detector moves relative to the fixed scaled unit may be acceptable.

Further, in the present exemplary embodiment, an example of a so-called magnetic encoder is illustrated where a relative movement amount between the scale unit 63 and the detector 62 is obtained through the change in magnetic field, but an optical encoder configured to obtain the movement amount through an optical change may also be acceptable.

Further, in the present exemplary embodiment, an example of the configuration is illustrated where the position of the tension bar 55 is obtained through the detection unit 60 configured to detect the displacement of the pivot of the pivot shaft 53, but a configuration where the position of the tension bar 55 is obtained through an encoder (detection unit) configured to detect the pivot of the output shaft of the electric motor 56 of the tension bar drive unit 18 and a shaft of various types of gears may also be acceptable.

Figure 4:
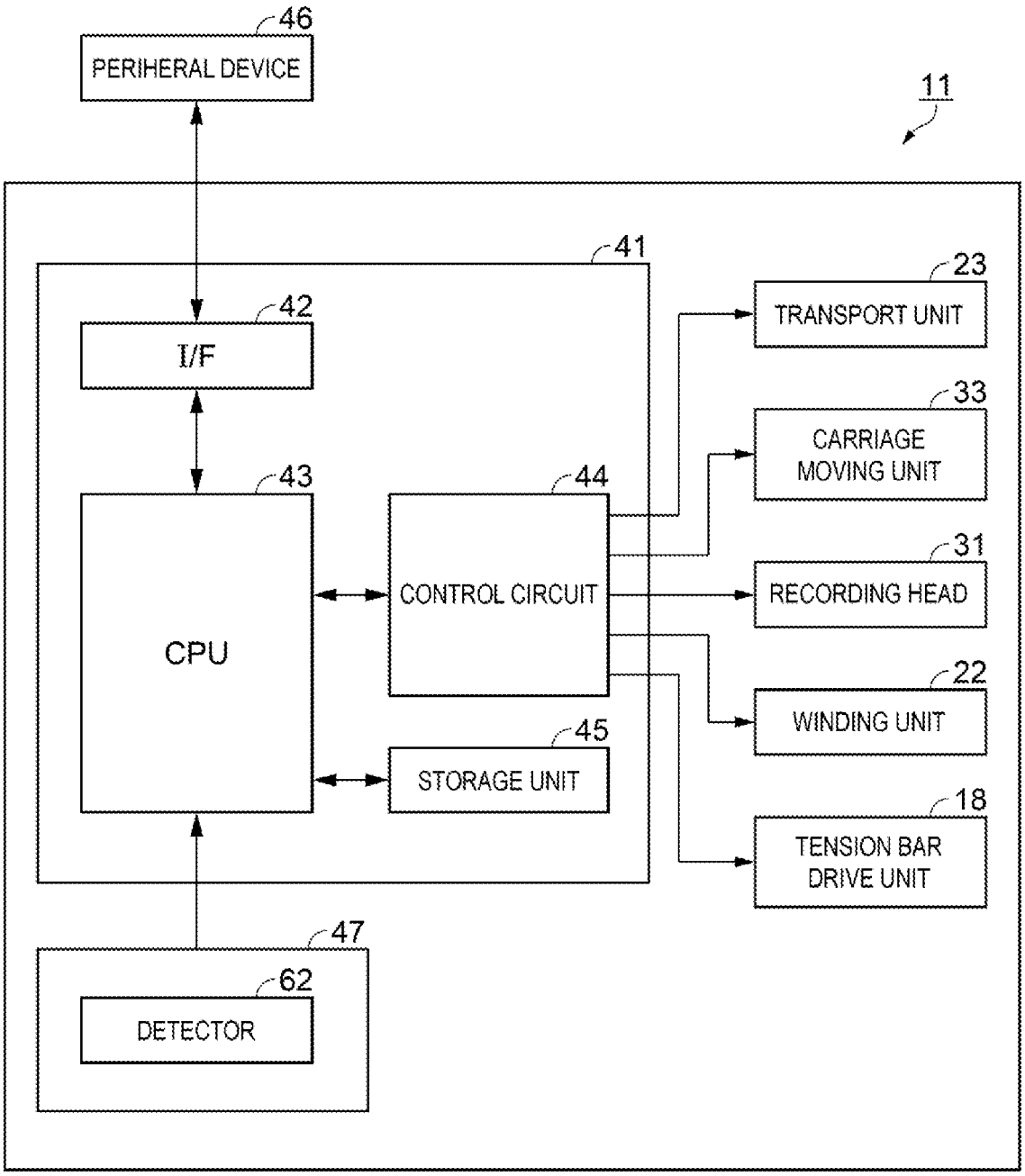
FIG. 4 is an electric block diagram illustrating an electrical configuration of the printing apparatus.

FIG. 4 is an electric block diagram illustrating an electrical configuration of the printing apparatus. Next, an electrical configuration of the printing apparatus 11 will be described with reference to FIG. 4.

The control unit 41 is a control unit configured to control the printing apparatus 11. The control unit 41 is configured with and includes a control circuit 44, an interface unit (I/F) 42, a Central Processing Unit (CPU) 43, and a storage unit 45. The interface 42 is for receiving and transmitting data between a peripheral device 46 configured to handle an image such as a computer, a digital camera, and the like, and the printing apparatus 11. The CPU 43 is an operation processing device configured to perform processing of an input signal from a detector group 47 and control of the entire printing apparatus 11.

Based on print data received from the peripheral device 46, the control unit 41 controls the transport motor 23M of the transport unit 23 by which the medium M is transported in the transport direction, the carriage moving unit 33 by which the carriage 32 is moved in a direction intersecting with the transport direction, and the recording head 31 configured to discharge the ink toward the medium M, based on a control signal output from the control circuit 44. Further, the control unit 41 controls the winding motor 22M of the winding unit 22 configured to wind the medium M, the electric motor 56 of the tension bar drive unit 18, and each device (not illustrated), based on a control signal output from the control circuit 44.

The storage unit 45 is for ensuring a region for storing programs of the CPU 43, a working area, and the like, and includes a storage element such as a Random Access Memory (RAM), and an Electrically Erasable Programmable Read Only Memory (EEPROM). The detector group 47 includes the detector 62 configured to detect a pivot change of the pivot shaft 53. The CPU 43 calculates the position of the tension bar 55, based on a signal output from the detector 62. Further, the detector group 47 includes a rotation detector (not illustrated) configured to detect a rotation of the pair of transporting rollers 23*a*. The CPU 43 obtains a transport amount of the medium M, based on a signal output from the rotation detector and calculates the diameter of the roll body R2 formed of the medium M wound around the winding unit 22.

Figure 5:
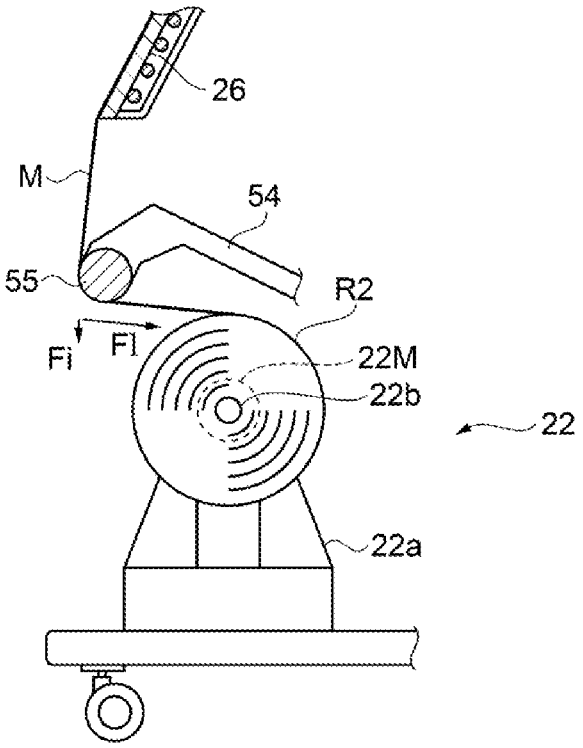
FIG. 5 is a diagram describing a force in the gravity axis acted on a tension bar when a medium is inwardly wound.
Figure 6:
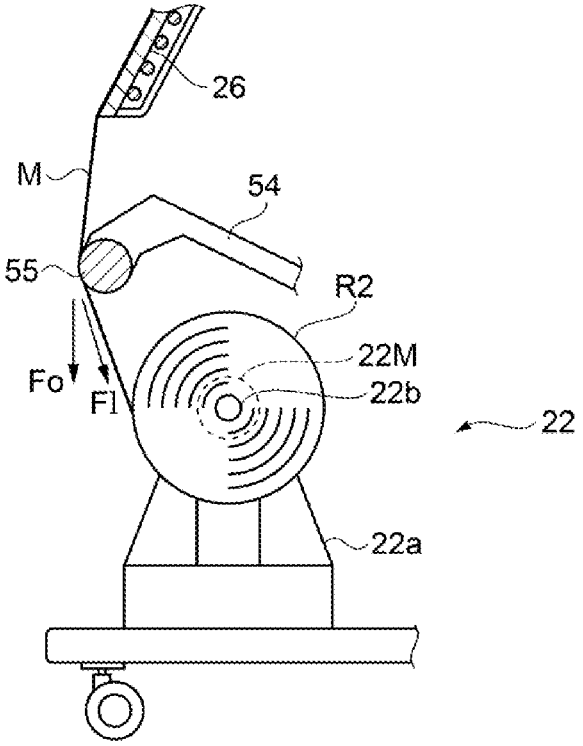
FIG. 6 is a diagram describing a force in the gravity axis acted on a tension bar when a medium is outwardly wound.

FIG. 5 is a diagram describing a force in the gravity axis acted on the tension bar when the medium M is inwardly wound. FIG. 6 is a diagram describing a force in the gravity axis acted on the tension bar when the medium M is outwardly wound. Next, the tension exerted on the medium M will be described with reference to FIG. 5 and FIG. 6.

When the medium M printed in the printing unit 13 is forwarded though the action of the transport unit 23, the tension bar 55, located at the upper limit position, pivots along the circumference around the pivot shaft 53 and moves toward the lower limit position. When the tension bar 55 reaches the lower limit position, the winding unit 22 is driven so that the medium M is wound in a roll shape. When the tension bar 55 rises to reach the upper limit position, the drive of the winding unit 22 is stopped. When this is repeated, the medium M forms the roll body R2.

A line of force Fi illustrated in FIG. 5 indicates a magnitude of a force in the gravity axis acted on the medium M when the medium M is inwardly wound by a load FI around the winding unit 22 via the tension bar 55 located at an illustrated position. A line of force Fo illustrated in FIG. 6 indicates a magnitude of a force in the gravity axis acted on the medium M when the medium M is outwardly wound by the same load FI around the winding unit 22 via the tension bar 55 located at the same position as in FIG. 5. The inward winding of the medium M and the outward winding thereof differ in axis in which the medium M moves from the tension bar 55 to the roll body R2, and thus, even if the medium M is wound by the same load FI by the winding unit 22, the force acted in the gravity axis on the medium M differs.

As illustrated in FIG. 5 and FIG. 6, an angle of the medium M formed when traveling from a downstream side end of the third support unit 26 via the tension bar 55 toward the roll body R2 is wider in the outward winding than in the inward winding. Thus, for the force toward the gravity axis acted on the medium M, the line of force Fo in the outward winding is larger than the line of force Fi in the inward winding. That is, the tension exerted on the medium M is larger in the outward winding than in the inward winding.

Figure 7:
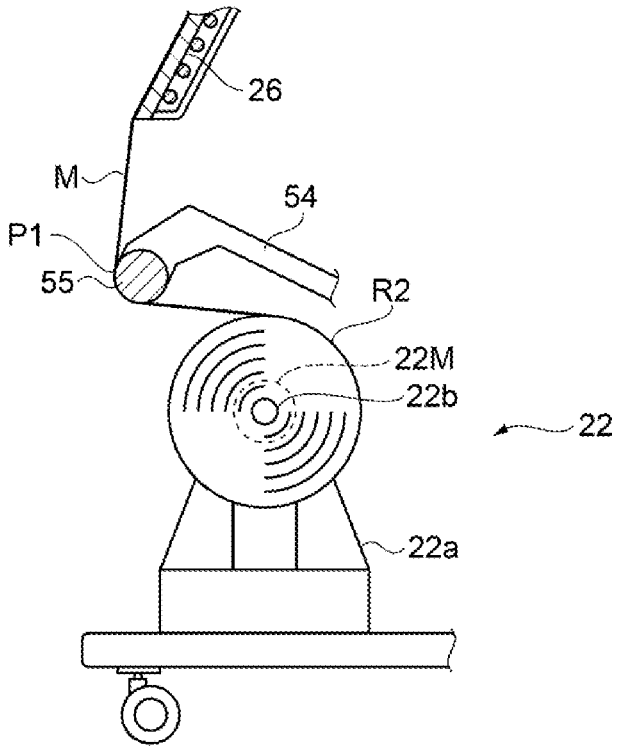
FIG. 7 is a lateral cross-sectional view illustrating a lower limit position of the tension bar in the internal winding.
Figure 8:
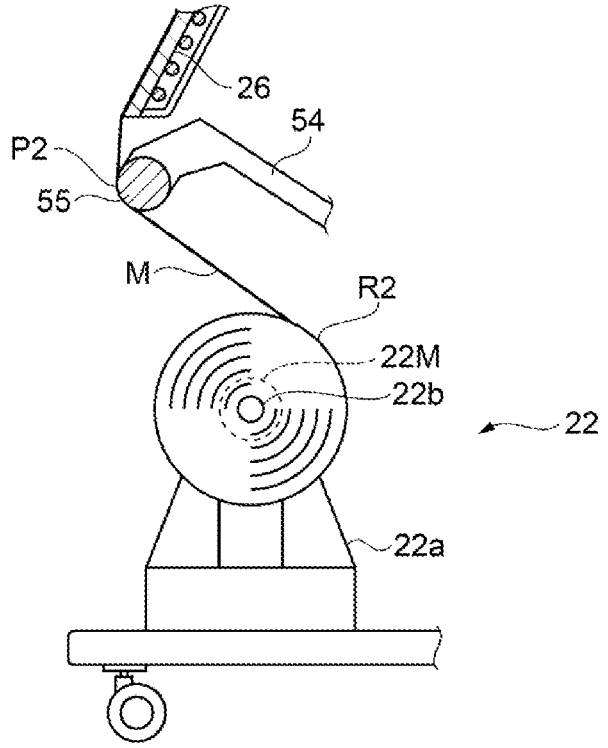
FIG. 8 is a lateral cross-sectional view illustrating an upper limit position of the tension bar in the internal winding.
Figure 9:
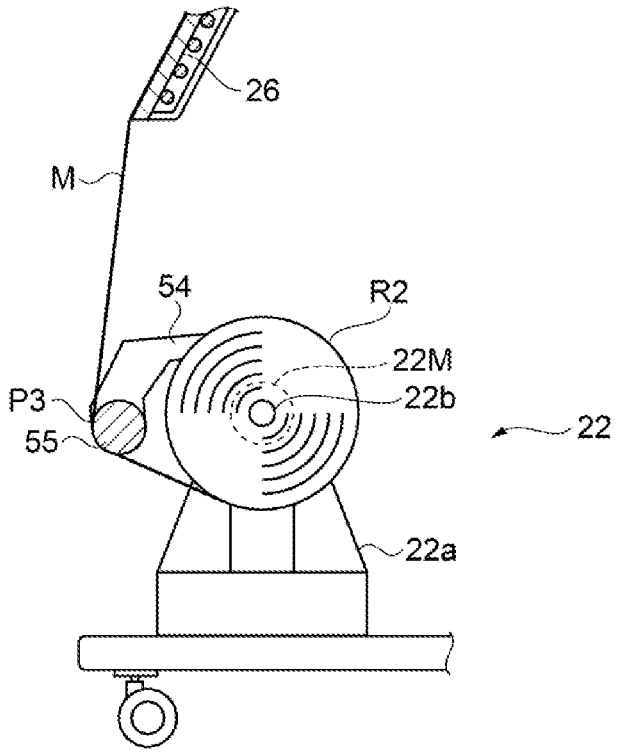
FIG. 9 is a lateral cross-sectional view illustrating a lower limit position of the tension bar in the outward winding.
Figure 10:
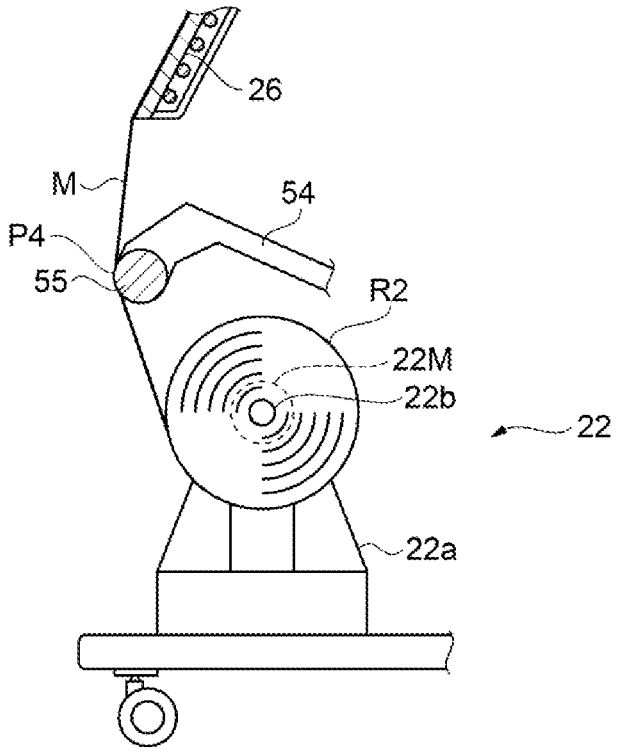
FIG. 10 is a lateral cross-sectional view illustrating an upper limit position of the tension bar in the outward winding.

FIG. 7 is a lateral cross-sectional view illustrating the lower limit position of the tension bar when the medium M is inwardly wound. FIG. 8 is a lateral cross-sectional view illustrating the upper limit position of the tension bar when the medium M is inwardly wound. FIG. 9 is a lateral cross-sectional view illustrating the lower limit position of the tension bar when the medium M is outwardly wound. FIG. 10 is a lateral cross-sectional view illustrating the upper limit position of the tension bar when the medium M is outwardly wound. Next, the position of the tension bar 55 when the medium M is outwardly wound and the position of the tension bar 55 when the medium M is inwardly wound will be described with reference to FIG. 7 to FIG. 10.

When the medium M mounted to the feed unit 21 is an inwardly wound roll body R1, the medium M is set on the winding unit 22 so that the medium M is inwardly wound. As illustrated in FIG. 7 and FIG. 8, the control unit 41 forwards the printed medium M through the action of the transport unit 23, drives the winding unit 22, when the tension bar 55 reaches a predetermined lower limit position P1, to wind the medium M, and positions the tension bar 55 at a predetermined upper limit position P2.

When the medium M mounted to the feed unit 21 is an outwardly wound roll body R1, the medium M is set on the winding unit 22 so that the medium M is outwardly wound. As illustrated in FIG. 9 and FIG. 10, the control unit 41 forwards the printed medium M through the action of the transport unit 23, drives the winding unit 22 when the tension bar 55 reaches a predetermined lower limit position P3 to wind the medium M, and positions the tension bar 55 at a predetermined upper limit position P4. Note that the control unit 41 determines whether the medium M is inwardly wound or outwardly wound, based on information on a winding mode of the winding unit 22 input to the peripheral device 46.

The control unit 41 modifies the upper limit position of a movement of the tension bar 55 along the circumference around the pivot shaft 53, being a predetermined axis, according to the winding mode of the winding unit 22. For example, when the medium M is outwardly wound, the control unit 41 modifies the upper limit position of the tension bar 55 from the upper limit position P2 for the inward winding to the upper limit position P4. As a result, at the upper limit position, an angle difference of the medium M moving from the tension bar 55 to the roll body R2 of the winding unit 22 generated depending on the winding mode is reduced, and thus, it is possible to suppress a change in tension exerted on the medium.

For example, when the medium M is outwardly wound, if the tension bar 55 is wound up to the upper limit position P2 for the inward winding by driving the winding unit 22, the tension exerted on the medium M is exceedingly higher than a predetermined tension.

Due to assembly accuracy (tolerance) of the printing apparatus 11 or the like, in the transport path from the pair of transporting rollers 23*a* to the winding unit 22, a difference may occur between a transport path length along an end at +X-axis side (one end) in the width axis of the medium M and a transport path length along an end at −X-axis side (another end). For example, when the transport path length at the +X-axis side is slightly shorter than the transport path length at the −X-axis side, a slight slack occurs in the medium M in the transport path at the +X-axis side (at the side where the transport path length is shorter).

At this time, during a step where the tension bar 55 is wound up to the upper limit position P2 for the inward winding, if a tension higher than a predetermined tension is exerted on the medium M, a tension concentrated line is generated where a tension is obliquely concentrated from another end of the winding unit 22 at the side where the transport path length is longer toward the one end of the pair of transporting rollers 23*a* at the side where the transport path length is shorter. This may result in a problem that the medium M at the side where the tension concentrates slips from the pair of transporting rollers 23*a* toward the downstream in the transport direction, decreasing a printing accuracy. However, in the printing apparatus 11 of the present exemplary embodiment, when the medium M is outwardly wound, the upper limit position is modified to the upper limit position P4 lower than the upper limit position P2 for the inward winding, and thus, the tension exerted on the medium M is decreased and it is thus possible to suppress a decrease in printing accuracy.

Further, at the upper limit position of the tension bar 55, when the angle of the medium M moving from the downstream side end of the third support unit 26 via the tension bar 55 toward the roll body R2 is kept approximately parallel to the gravity axis, a force of pulling the medium M downstream of the pair of transporting rollers 23*a* with its own weight into the gravity axis increases. This provides an effect to cancel the slack of the medium M occurring due to the difference in transport path length between the one end of the transport path and another end thereof.

For example, when the medium M is inwardly wound, if the upper limit position of the tension bar 55 is the same as the upper limit position P4 for the outward winding, the medium M moving from the tension bar 55 toward the roll body R2 is in an approximately horizontal state, and as a result, the effect of canceling the slack of the medium M may be deteriorated. However, in the printing apparatus 11 of the present exemplary embodiment, when the medium M is inwardly wound, the upper limit position of the tension bar 55 is modified to the upper limit position P2 higher than the upper limit position P4 for the outward winding. As a result, the angle of the medium M moving from the tension bar 55 toward the roll body R2 is closer to the gravity axis, and thus, the effect of canceling the slack of the medium M is exhibited.

The control unit 41 modifies the lower limit position of a movement of the tension bar 55 along the circumference around the pivot shaft 53, being a predetermined axis, according to the winding mode of the winding unit 22. For example, when the medium M is outwardly wound, the control unit 41 modifies the lower limit position of the tension bar 55 from the lower limit position P1 for the inward winding to the lower limit position P3. Further, when the medium M is inwardly wound, the control unit 41 modifies the lower limit position of the tension bar 55 from the lower limit position P3 for the outward winding to the lower limit position P1. As a result, at the lower limit position, an angle difference of the medium M moving from the tension bar 55 to the roll body R2 of the winding unit 22 generated depending on the winding mode is reduced, and thus, it is possible to suppress a change in tension exerted on the medium M.

Figure 11:
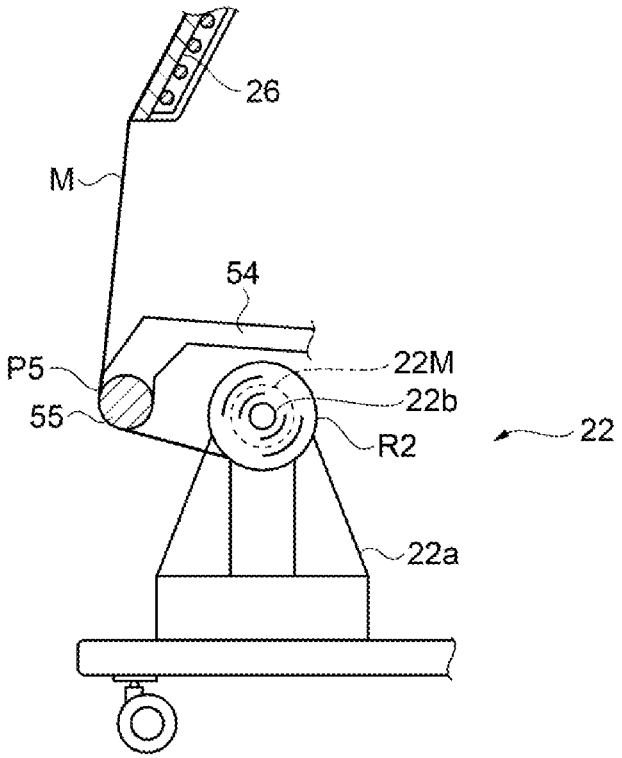
FIG. 11 is a lateral cross-sectional view illustrating the lower limit position of the tension bar when a diameter of an outwardly wound roll body is small.
Figure 12:
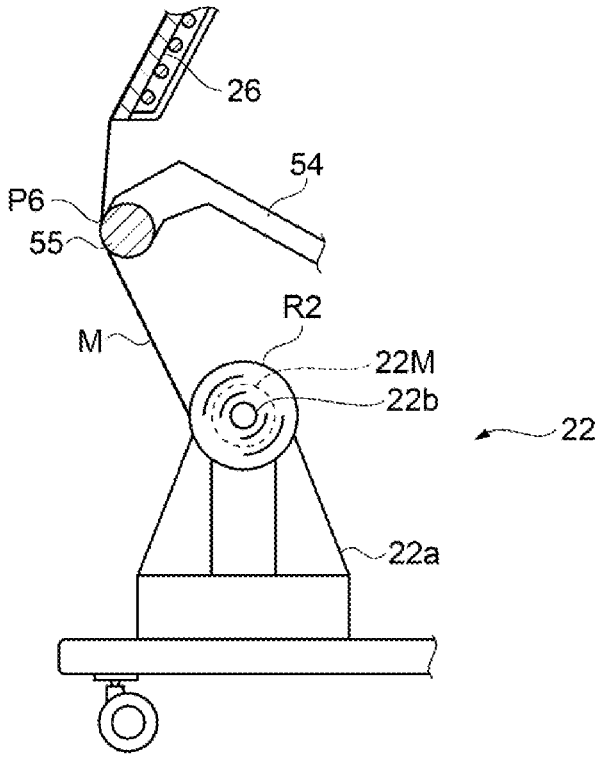
FIG. 12 is a lateral cross-sectional view illustrating the upper limit position of the tension bar when a diameter of an outwardly wound roll body is small.

FIG. 11 is a lateral cross-sectional view illustrating the lower limit position of the tension bar when a diameter of an outwardly wound roll body is small. FIG. 12 is a lateral cross-sectional view illustrating the upper limit position of the tension bar when a diameter of an outwardly wound roll body is small. Next, the position of the tension bar 55 depending on the size of the diameter of the roll body R2 will be described with reference to FIG. 9 to FIG. 12.

The diameter of the roll body R2 formed by winding the medium M around the winding unit 22 increases as the winding amount increases. For example, when each of the lower limit position and the upper limit position of the tension bar 55 is fixed at a certain position, depending on the size of the diameter of the roll body R2, the angle of the medium M moving from the tension bar 55 toward the roll body R2 differs, and the tension exerted on the medium M changes.

Therefore, the control unit 41 of the printing apparatus 11 in the present exemplary embodiment modifies the upper limit position and the lower limit position of the tension bar 55, according to the diameter of the medium M wound around the winding unit 22 (diameter of the roll body R2). The control unit 41 calculates the diameter of the roll body R2 from the transport amount of the medium M, and as the diameter of the roll body R2 increases in size, gradually modifies the lower limit position of the tension bar 55, from a lower limit position P5 where the diameter of the roll body R2 is small, as illustrated in FIG. 11, to the lower limit position P3 where the diameter of the roll body R2 is large, as illustrated in FIG. 9. Further, the control unit 41 gradually modifies the upper limit position of the tension bar 55, from an upper limit position P6 where the diameter of the roll body R2 is small, as illustrated in FIG. 12 to the upper limit position P4 where the diameter of the roll body R2 is large, as illustrated in FIG. 10.

As a result, at the upper limit position and the lower limit position, an angle difference of the medium M moving from the tension bar 55 to the roll body R2 of the winding unit 22 generated depending on the size of the diameter of the roll body R2 is reduced, and thus, it is possible to suppress a change in tension exerted on the medium M.

Note that description is provided that the printing apparatus 11 in the present exemplary embodiment obtains the transport amount of the medium from the output of the rotation detector configured to detect the rotation of the pair of transporting rollers 23*a* to calculate the diameter of the roll body R2, however, the printing apparatus 11 may include a length measuring device such as an ultrasonic sensor and be configured to directly obtain the diameter.

As described above, the printing apparatus 11 according to the present exemplary embodiment can provide the following advantages.

The control unit 41 of the printing apparatus 11 in the present exemplary embodiment modifies the upper limit position and the lower limit position of the movement of the tension bar 55 along the circumference around the pivot shaft 53, according to the winding mode (the inward winding or the outward winding) of the winding unit 22. As a result, at the upper limit position and the lower limit position, an angle difference of the medium M moving from the tension bar 55 to the roll body R2 of the winding unit 22 generated depending on the winding mode is reduced, and thus, it is possible to suppress a change in tension exerted on the medium.

The tension applying unit 15 includes a detection unit 60 configured to detect a displacement of the pivot of the pivot shaft 53. This enables obtaining the position of the tension bar 55 rotationally moving around the pivot shaft 53.

The control unit 41 modifies the upper limit position and the lower limit position of the tension bar 55, according to the diameter of the medium M wound around the winding unit 22 (diameter of the roll body R2). As a result, at the upper limit position and the lower limit position, an angle difference of the medium M moving from the tension bar 55 to the roll body R2 of the winding unit 22 generated depending on the diameter of the roll body R2 is reduced, and thus, it is possible to suppress a change in tension exerted on the medium M.

This application claims priority under 35 U.S.C. § 119 to Japanese Patent Application No. 2017-234015, filed Dec. 6, 2017. The entire disclosure of Japanese Patent Application No. 2017-234015 is hereby incorporated herein by reference.

What is claimed is:

1. A printing apparatus, comprising:

a transport unit configured to transport a medium;

a winding unit disposed downstream, in a transport direction, of the transport unit, the winding unit being configured to wind the medium;

a tension applying unit including a rod member biased toward the medium between the transport unit and the winding unit, the rod member being for applying a tension to the medium; and a control unit configured to control the tension applying unit, wherein the tension applying unit is configured so that the rod member moves along a predetermined axis as at least one of the transport unit and the winding unit is driven to transport the medium, an upper limit position of a movement of the rod member along the predetermined axis is changed according to a winding mode of the winding unit, the winding mode includes an inwardly wound mode and an outwardly wound mode, and the control unit is further configured to:

acquire the winding mode of the winding unit, and control the tension apply unit based on the acquired winding mode so that an upper limit position of the rod member, when the winding mode is the inwardly wound mode, is higher than an upper limit position of the rod member when the winding mode is the outwardly wound mode.

2. The printing apparatus according to claim 1, wherein the upper limit position is changed according to a diameter of the medium wound around the winding unit.

3. The printing apparatus according to claim 1, wherein the rod member is configured to pivot along a circumference, and the tension applying unit includes a pivot shaft around which the rod member pivots and a detection unit configured to detect a displacement of a pivot of the pivot shaft.

4. The printing apparatus according to claim 1, wherein a lower limit position of a movement of the rod member along the predetermined axis is changed according to a winding mode of the winding unit.

5. The printing apparatus according to claim 1, wherein a lower limit position of a movement of the rod member along the predetermined axis is changed according to a diameter of the medium wound around the winding unit.

6. A printing apparatus, comprising:

a transport unit configured to transport a medium;

a winding unit disposed downstream, in a transport direction, of the transport unit, the winding unit being configured to wind the medium;

a tension applying unit including a rod member biased toward the medium between the transport unit and the winding unit, the rod member being for applying a tension to the medium; and a control unit configured to control the tension applying unit, wherein the tension applying unit is configured so that the rod member moves along a predetermined axis as at least one of the transport unit and the winding unit is driven to transport the medium, and an upper limit position of a movement along the predetermined axis of the rod member is changed according to a diameter of the medium wound around the winding unit, the diameter increases from a first diameter to a second diameter that is larger than the first diameter by being wound by the winding unit, the control unit is further configured to:

acquire a diameter of a roll body formed by the winding unit, and control the tension applying unit based on the acquired diameter so that an upper limit position of the rod member when the diameter is the second diameter is lower than an upper limit position of the rod member when the diameter is the first diameter.

7. The printing apparatus according to claim 6, wherein the upper limit position is changed according to a winding mode of the winding unit.

8. The printing apparatus according to claim 6, wherein the rod member is configured to pivot along a circumference axis, and the tension applying unit includes a pivot shaft around which the rod member pivots and a detection unit configured to detect a displacement of a pivot of the pivot shaft.

9. The printing apparatus according to claim 6, wherein a lower limit position of a movement of the rod member along the predetermined axis is changed according to a winding mode of the winding unit.

10. The printing apparatus according to claim 6, wherein a lower limit position of a movement of the rod member along the predetermined axis is changed according to a diameter of the medium wound around the winding unit.

11. A printing apparatus, comprising:

a transport unit configured to transport a medium;

a winding unit disposed downstream, in a transport direction, of the transport unit, the winding unit being configured to wind the medium;

a tension applying unit including a rod member biased toward the medium between the transport unit and the winding unit, the rod member being for applying a tension to the medium, and a control unit configured to control the tension applying unit, wherein the tension applying unit is configured so that the rod member moves along a predetermined axis as at least one of the transport unit and the winding unit is driven to transport the medium, and the control unit is further configured to:

acquire a diameter of a roll body formed by the winding unit, and control the tension applying unit so that an upper limit position of a movement along the predetermined axis of the rod member is changed according to the diameter.

* * * * *